US008344302B1

(12) United States Patent
Murphy et al.

(10) Patent No.: US 8,344,302 B1
(45) Date of Patent: Jan. 1, 2013

(54) OPTICALLY-COUPLED COMMUNICATION INTERFACE FOR A LASER-GUIDED PROJECTILE

(75) Inventors: Matthew G. Murphy, Sahuarita, AZ (US); Jesse H. Blake, Tucson, AZ (US); Carlos Garcia, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 333 days.

(21) Appl. No.: 12/794,983

(22) Filed: Jun. 7, 2010

(51) Int. Cl.

| | |
|---|---|
| ***F41G 7/22*** | (2006.01) |
| ***F42B 15/01*** | (2006.01) |
| *F41G 7/00* | (2006.01) |
| *F42B 15/00* | (2006.01) |

(52) U.S. Cl. ..... 244/3.16; 244/3.1; 244/3.15

(58) Field of Classification Search ..... 244/3.1–3.3; 89/1.11; 375/239; 102/200, 206, 211, 213; 342/13, 61, 62; 356/3, 4.01, 5.01, 5.1, 5.14
See application file for complete search history.

(56) References Cited

U.S. PATENT DOCUMENTS

| | | | | | |
|---|---|---|---|---|---|
| 3,366,346 | A | * | 1/1968 | McKnight et al. | 244/3.11 |
| 4,047,117 | A | * | 9/1977 | Tuchyner et al. | 244/3.16 |
| 4,143,835 | A | * | 3/1979 | Jennings et al. | 244/3.11 |
| 4,179,088 | A | * | 12/1979 | French | 244/3.19 |
| 4,269,121 | A | * | 5/1981 | Sochard | 102/213 |
| 4,338,602 | A | * | 7/1982 | Roeder et al. | 342/62 |
| 4,407,465 | A | * | 10/1983 | Meyerhoff | 244/3.16 |
| 4,558,836 | A | * | 12/1985 | Kriegesmann | 244/3.11 |
| H299 | H | * | 7/1987 | Miller, Jr. | 244/3.13 |
| 4,796,834 | A | * | 1/1989 | Ahlstrom | 244/3.16 |
| 5,023,888 | A | * | 6/1991 | Bayston | 375/239 |
| 5,026,156 | A | * | 6/1991 | Bayston et al. | 342/13 |
| 5,664,741 | A | * | 9/1997 | Duke | 244/3.11 |
| 6,031,601 | A | * | 2/2000 | McCusker et al. | 356/5.01 |
| 6,057,949 | A | | 5/2000 | Kinstler | |
| 6,265,704 | B1 | * | 7/2001 | Livingston | 356/4.01 |
| 6,568,627 | B1 | * | 5/2003 | Jones et al. | 244/3.13 |
| 6,926,227 | B1 | * | 8/2005 | Young et al. | 244/3.13 |
| 6,987,256 | B2 | * | 1/2006 | English et al. | 356/5.14 |
| 7,059,560 | B2 | * | 6/2006 | Ljungberg et al. | 244/3.13 |
| 7,175,130 | B2 | * | 2/2007 | Dubois et al. | 244/3.13 |
| 7,343,231 | B2 | | 3/2008 | Zoltan | |
| 7,745,767 | B2 | * | 6/2010 | Bredy | 244/3.16 |
| 7,767,945 | B2 | * | 8/2010 | Williams | 244/3.16 |
| 8,033,221 | B2 | * | 10/2011 | Edwards | 244/3.16 |
| 2009/0000465 | A1 | * | 1/2009 | Deflumere et al. | 89/1.11 |
| 2009/0078817 | A1 | * | 3/2009 | Williams | 244/3.16 |

* cited by examiner

*Primary Examiner* — Bernarr Gregory
(74) *Attorney, Agent, or Firm* — Eric A. Gifford

(57) ABSTRACT

A communication interface for a laser-guided projectile is configured to use the SAL seeker on board the laser-guided projectile as a communication link. A communication device generates a pulsed optical beam that overlaps the detection band of the SAL seeker. The pulsed optical beam is encoded with data for the SAL seeker. Computer-readable program code is loaded into and executed by the seeker's signal processor to process the signals generated in response to the pulsed optical beam to extract the data for the SAL seeker. Data is typically coupled to the projectile pre-launch but may be coupled in flight to the target.

24 Claims, 8 Drawing Sheets

OPTICALLY-COUPLED COMMUNICATION INTERFACE FOR A LASER-GUIDED PROJECTILE

GOVERNMENT RIGHTS

This invention was made with United States Government support under Contract Number FA9453-06-D-0104 with the United States Air Force. The United States Government has certain rights in this invention.

BACKGROUND OF THE INVENTION

1. Field of the Invention

This invention relates to laser-guided projectiles and more particularly to an optically-coupled communication interface using SAL seeker.

2. Description of the Related Art

Laser guided ordinance is commonly used to engage point targets with a high probability of success and minimal collateral damage. Such ordinance includes guided artillery projectiles, guided missiles, and guided bombs, all of which will be referred to herein as "laser-guided projectiles".

A laser-guided projectile includes a semi-active laser (SAL) seeker to detect pulsed IR laser electro-magnetic radiation (EMR) scattered from the intended target and to provide signals indicative of the target bearing such that the projectile can be guided to the target. The SAL includes a non-imaging optical system to capture and focus the scattered laser EMR onto a detector assembly. The optical system convert the target bearing to an irradiance distribution or "spot" positioned on the detector. As the target bearing changes the position of the spot on the detector changes.

Referring now to FIG. 1*a,* soldier A 10 inputs pre-launch data required by the projectile 12. Pre-launch data may include the guidance mode, fuze timing mode, fuze detonation mode, range to target, target location, lock mode or atmospheric conditions. The pre-launch data may be input via a hardwired interface between the launch tube and the projectile, an RF interface, an electro-magnetic inductive interface or a mechanical interface such as a rotary clicking switch. The specific interface is dictated by the weapon system. Soldier A places projectile 10 into a launch tube 14 (or rack or some other launch platform).

Referring now to FIG. 1*b,* soldier B 16 uses a laser designator 18 to illuminate a target 20 with pulsed laser radiation 22. The target is represented as a tank, but may be another type of vehicle, ship, boat, or a structure, building or other stationary object. Laser designators radiate in a narrow beam of pulsed energy. Current tactical lasers operate in the near IR wavelength spectrum, which is not visible to the human eye. They can be aimed so the energy precisely designates a chosen spot on the target. The laser designator may be located on the ground, as shown in FIG. 1*b,* or may be located in a vehicle, ship, boat, or aircraft. An automated tracking system may be used to point the designator to illuminate the target.

Soldier A points the launch tube at the target to acquire the scatter laser radiation 24 from the target 20 and fires the projectile. Laser guided projectile 12 engage target 20 by detecting and following scattered laser radiation 24 from the target 20. The laser guided projectile 12 includes a projectile body, a warhead, control surfaces, and a guidance system. The guidance system includes a SAL seeker and a flight computer to control the flight of the laser guided projectile by manipulating one or more control surfaces based on at least one guidance signal from the SAL seeker. The control surfaces may be canards fins, wings, ailerons, elevators, spoilers, flaps, air brakes or other controllable devices capable of affecting the flight path of the laser guided projectile.

Laser designators and seekers use a pulse coding system to ensure that a specific seeker and designator combination work in harmony. Pulse coding is typically based on Pulse Repetition Frequency (PRF) coding. By setting the same code 26 in both the designator and the seeker, the seeker will track only the target designated by the designator. Current pulse codes use a truncated decimal system that uses the numerical digits 1 through 8, and the codes are directly correlated to a specific PRF. Typical equipment uses either a three or four-digit code. The designator repeats the code in the emitted pulsed laser beam that is directed at the target to "paint" the target and reflected back to the seeker. The seeker may be configured to recognize multiple different codes. The seeker verifies the code embedded in the pulsed laser radiation. Details of PRF coding for laser-designated weapons are provided in U.S. Pat. Nos. 5,023,888 and 5,026,156, which are hereby incorporated by reference.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a communication interface for a laser-guided projectile.

This is accomplished by using the SAL seeker on board the laser-guided projectile as a communication link. A communication device generates a pulsed optical beam that overlaps the detection band of the SAL seeker. The pulsed optical beam is encoded with data for the SAL seeker. Computer-readable program code is loaded into and executed by the seeker's signal processor to process the signals generated in response to the pulsed optical beam to extract the data for the SAL seeker. Data is typically coupled to the projectile pre-launch but may be coupled in flight to the target.

The communication interface may be retrofit to existing guided projectiles having SAL seekers, retrofit with a SAL seeker to unguided rockets to provide guidance and communication or integrated in a comprehensive design of a guided projectile. Use of the SAL seeker as a communication link allows either for the provision of SAL guidance to an unguided rocket that does not have other communication capability or for the elimination of other communication links in a guided-projectile design.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a communication interface for a laser-guided projectile. This is accomplished by using the SAL seeker on board the laser-guided projectile as a communication link. A communication device generates a pulsed optical beam that overlaps the detection band of the SAL seeker. The pulsed optical beam is encoded with data for the SAL seeker. Computer-readable program code is loaded into and executed by the seeker's signal processor to process the signals generated in response to the pulsed optical beam to extract the data for the SAL seeker. Data is typically coupled to the projectile pre-launch but may be coupled in flight to the target.

The communication interface may be incorporated into guided projectiles having an existing SAL seeker to provide a communication link or an alternate communication, into unguided projectiles along with a SAL seeker retrofit to provide both communication and guidance or into a new guided projectile design. Unguided projectiles that are retrofit with a SAL seeker may have no means of communication. This approach provides a means for communicating pre-launch data using the retrofitted SAL seeker. This approach also facilities the design and manufacture of a smaller, lighter and less expensive guided-projectiles by eliminating the need for additional communication links. The SAL seeker multi-tasks as both the communication interface and guidance system.

Figure 1A:
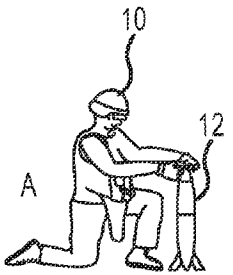
FIG.1a (PRIOR ART)
FIG. 1, as described above, depicts SAL seeker guidance of a projectile to a painted target.
Figure 1B:
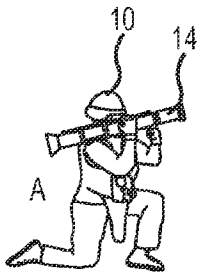
FIG.1b (PRIOR ART)
Figure 1B:
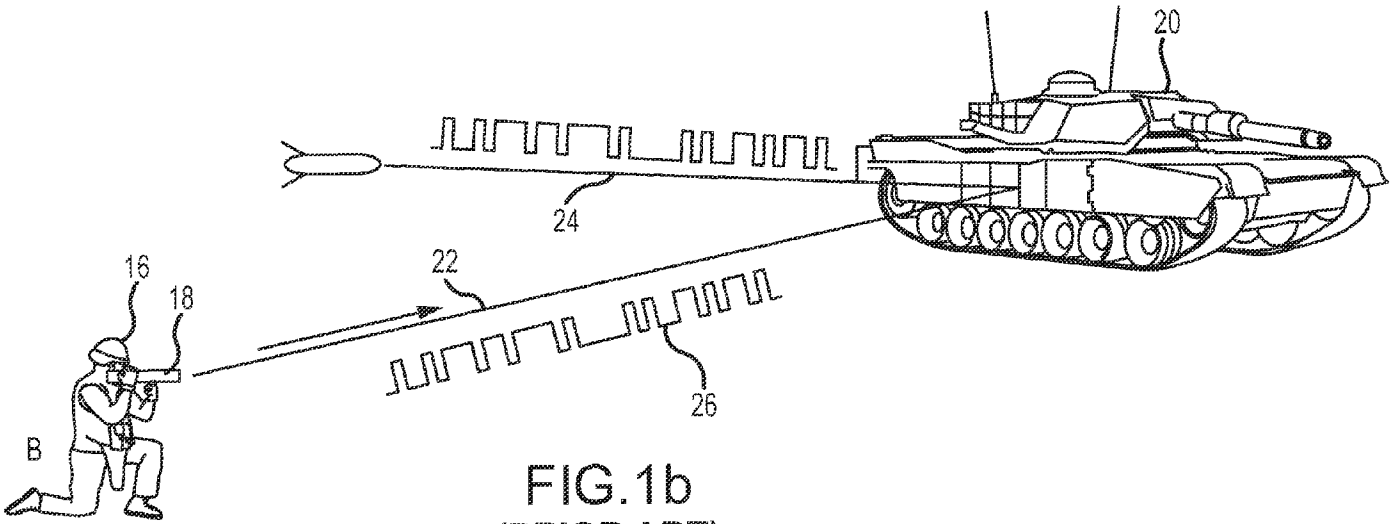
FIG.1b (PRIOR ART)
Figure 2:
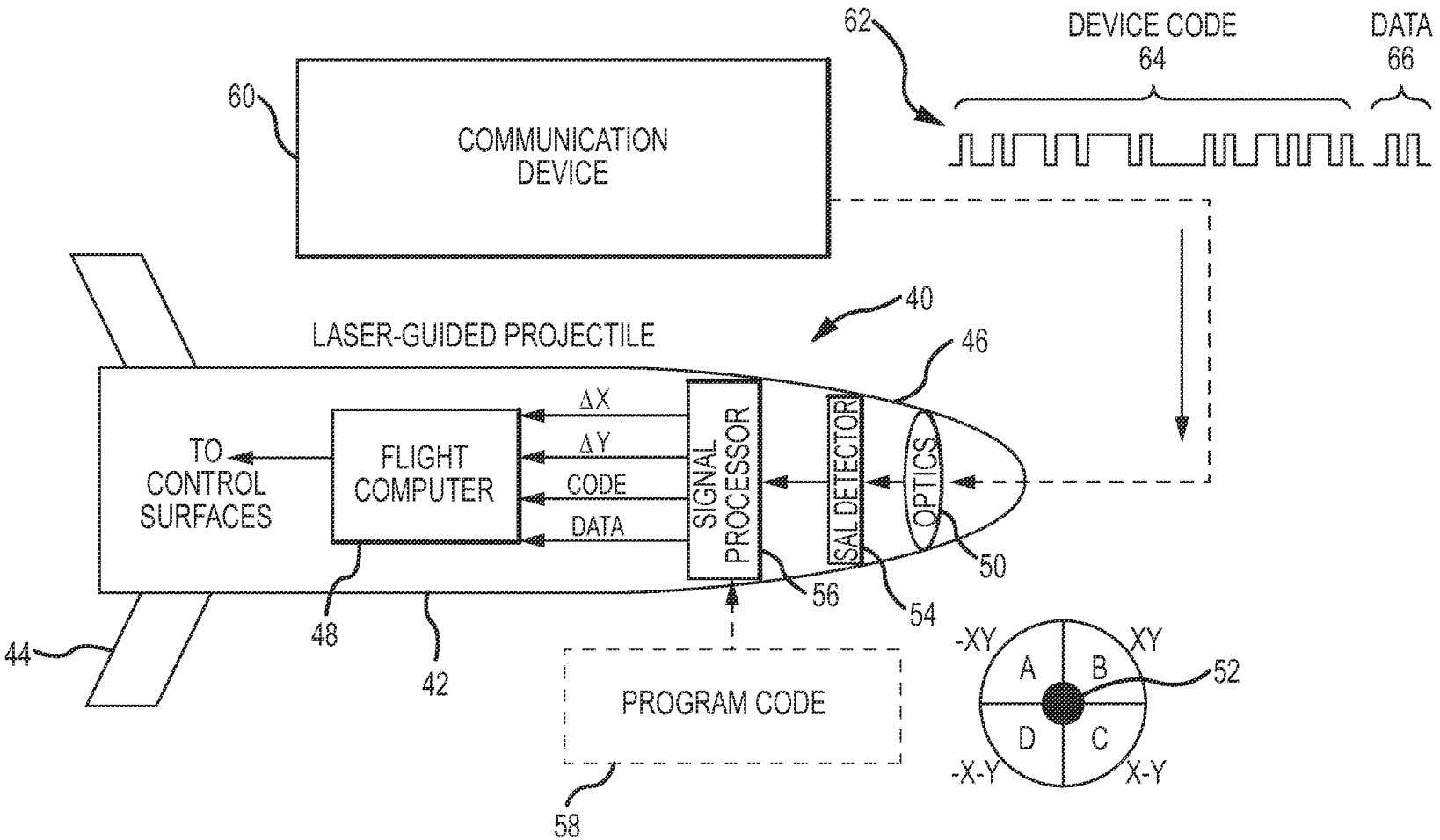
FIG. 2 is a block diagram of an optically-coupled communication interface for a SAL Seeker on a guided projectile in accordance with the present invention.

Referring now to FIG. 2, an embodiment of a laser-guided projectile 40 includes a projectile body 42, aerodynamic control surfaces 44, a SAL seeker 46 and a flight computer 48. Although not shown, the projectile will typically also include a fuze assembly and an explosive warhead. SAL seeker 46 comprises receiver optics 50 that capture and direct PRF coded IR laser electro magnetic radiation (EMR) to form a laser spot 52 on a SAL detector 54, which in turn generates one or more signals. A signal processor 56 executes computer-readable program code 58 to process the one or more signals to extract information from the PRF code and to generate one or more guidance signals ($\Delta X$, $\Delta Y$) indicative of the position of the laser spot on the SAL detector. Flight computer 48 processes the information and guidance signals.

SAL detector 54 may comprise four quadrants A, B, C, D. Other detector configurations may be used. Each quadrant produces a corresponding signal A, B, C, and D in response to the laser power in laser spot 52 incident upon each quadrant. Guidance signal $\Delta X$ indicates an imbalance between the laser power incident upon the left (quadrants A and B) and right (quadrants C and D) halves of the detector. Guidance signal $\Delta Y$ indicates an imbalance between the laser power incident upon the top (quadrants A and C) and bottom (quadrants B and D) halves of the detector. SAL detector 54 suitably comprises an A/D converter that converts the analog signals to digital signals. The terms "left", "right", "top", and "bottom" refer to the detector as shown in FIG. 2 and do not imply any physical orientation within a projectile. When the laser spot 52 is centered on the detector, the signals A, B, C, D may be essentially equal and the guidance signals $\Delta X$ and $\Delta Y$ may both be zero or nearly zero.

The position of SAL seeker 46 may be fixed within a projectile such as the projectile 40. This may be referred to as "body fixed". For example, the SAL seeker may be disposed within the projectile such that an optical axis of the SAL seeker is aligned with a longitudinal axis of the projectile. In this case, the laser spot may be centered on the detector when the longitudinal axis of the projectile is pointed directly at the designated target. The SAL seeker may be mounted on a gimbal within the projectile such that the optical axis of the SAL seeker may be rotated with respect to the longitudinal axis of the projectile. In this case, the laser spot may be centered on the detector when the optical axis of the SAL seeker is pointed directly at the designated target without the longitudinal axis of the projectile necessarily being pointed directly at the designated target.

In a pre-launch mode, a communication device 60 generates a PRF coded IR laser beam 62 that overlaps the detection band of the SAL detector. The communication device uses PRF coding to encode a device code 64 and pre-launch data 66 onto the beam. As shown the device code 64 is provided in the same field as the laser designator code for guiding the projectile to the target. Alternately, the device code 64 could be provided as part of the data. Beam 62 is positioned in the field-of-view of the seeker's optical system, which captures and directs EMR onto the SAL detector, which in turn generates one or more (e.g. four) signals. Signal processor 56 executes a portion of program code 58 that extracts the device code 64 and pre-launch data 66 from the PRF coded beam. Flight computer 48 verifies device code 64 and processes pre-launch data 66. Pre-launch data 66 may include fields for the guidance mode (ATA, ATG, GTG), fuze timing mode (airburst, point detonation, delayed detonation), fuze detonation mode (blast fragmentation, penetration), range to target, target location, lock mode (lock on before/after launch) or atmospheric conditions (temperature, wind, humidity). Beam 62 may be encoded with the actual data or with indices to data tables stored within the flight computer. Start and end bits may be inserted around the data to return the SAL to the normal PRF code mode. In pre-launch mode, the position of the laser spot and the guidance signals have no meaning. The signal processor and flight computer may suspend processing of the guidance signals.

In a launch mode, a laser designator illuminates a target with a PRF coded IR laser beam. The laser-guided projectile 40 is pointed at the target to acquire the laser EMR scattered from the target and lock on before launch. Once locked, the projectile is fired. The scattered EMR in the seeker's field-of-view is captured and formed into a spot on the SAL detector, which in turn generates one or more (e.g. four) signals. Signal processor 56 executes a portion of program code 58 that extracts the designator code from the PRF coded beam and generates one or more guidance signals ($\Delta X$, $\Delta Y$) indicative of the position of the laser spot on the SAL detector. Flight computer 48 verifies the designator code, calculates a bear to the target from the guidance signals and issues control signals to control aerodynamic control surfaces 44 to guide the projectile to the target.

Figure 3:
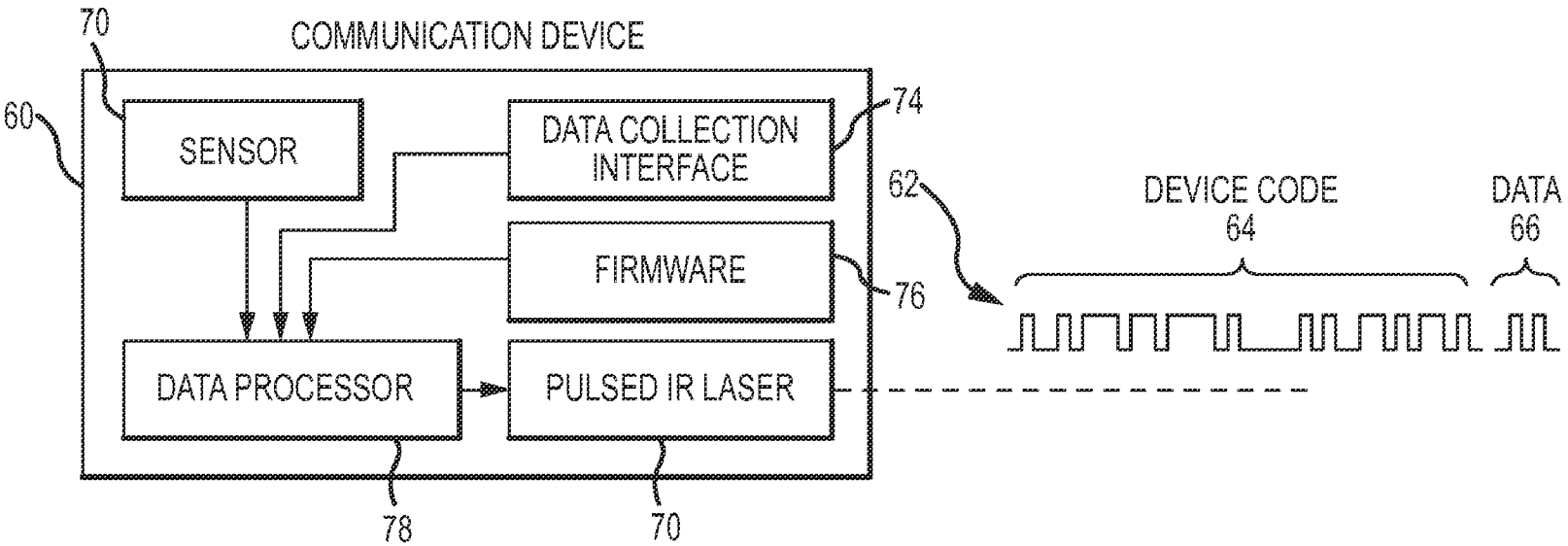
FIG. 3 is a block diagram of an embodiment of a communication device.

Referring now to FIG. 3, an embodiment of communication device 60 comprises a pulsed IR laser 70, one or more sensors 72 for acquiring data, a data collection interface 74 for acquiring data, firmware 76 and a data processor 78 that processes the acquired data to generate the PRF codes to modulate the pulsed IR laser 70 to generate beam 62. Pulsed IR laser 70 may comprise a laser diode, an LED or a higher power laser such as used in a laser range finder (LRF) or laser designator. Sensors 70 may include environment sensors to acquire atmospheric data including wind speed and direction, temperature, pressure humidity etc. Sensor may also include a LRF to provide range-to-target and a GPS receiver to provide a position of the target. Data collection interface 74 may include a numeric key pad or GUI for data entry or mode selection by the user, a port (hardwired or wireless) to receive data from a computer and one or more ports to receive data from an LRF or GPS that are not part of the device's sensor package. Firmware 76 can provide reprogramming and software updates for the projectile and detonation mode inputs. Data processor 78 formats the data into fields expected by the program code in the SAL seeker. For example, the data processor may place the device code 64 in the field normally occupied by the designator code. The device code may be followed by a start bit indicating the start of the "pre-launch data" and the one or more fields of pre-launch data followed by an end bit indicating the end of the data. The data processor may be configured to repeat the device code 64 and pre-launch data 66 until the SAL seeker acknowledges receipt and verification of the data.

Figure 4A:
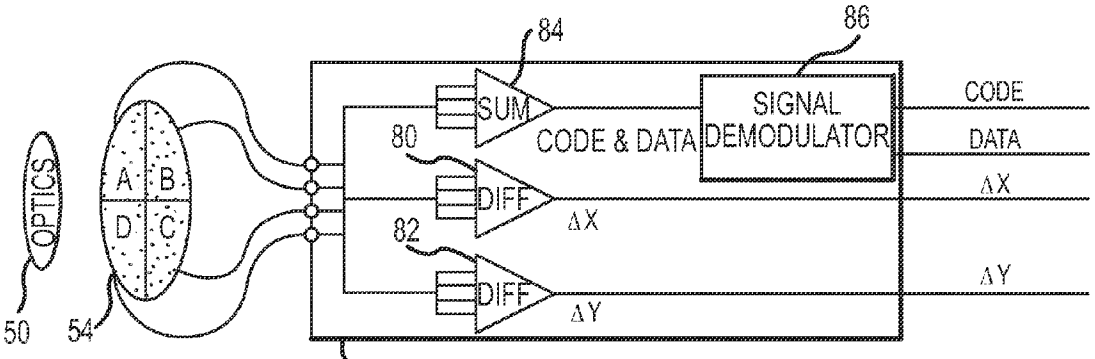
FIGS. 4*a* and 4*b* are functional and program code diagrams of an embodiment of the signal processor.
Figure 4B:
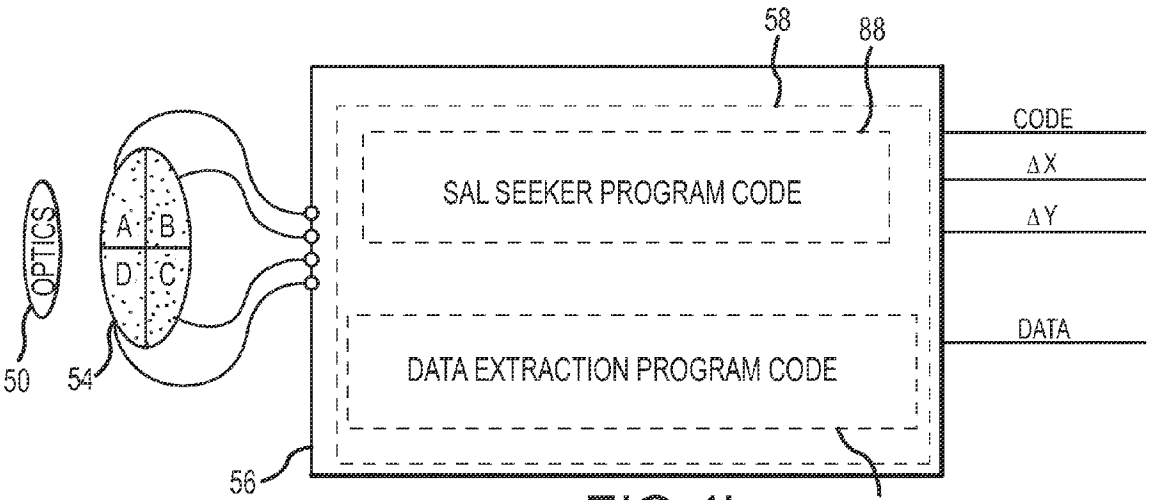

FIGS. 4*a* and 4*b* depict functional and program code blocks of an embodiment of signal processor 56. Signal processor 56 stores computer readable program code 58 in memory and executes the code to extract PRF coded information (device or designator codes and any pre-launch data) from the detected EMR and to generate the guidance signals ($\Delta X$, $\Delta Y$). The logic circuitry and technique for decoding the PRF coded beam is suitably the technique described in U.S. Pat. Nos. 5,023,888 and 5,026,156.

Functionally program code 58 implements first and second difference circuits 80 and 82 that generate signal $\Delta X$ as an imbalance between the laser power incident upon the left (quadrants A and B) and right (quadrants C and D) halves of the detector and signal $\Delta Y$ as an imbalance between the laser power incident upon the top (quadrants B and C) and bottom (quadrants A and D) halves of the detector. Program code 58 implements a summing circuit 84 that sums the signals generated by the A, B, C and D quadrants into a single PRF coded signal and a signal demodulator 86 that extracts the code (device or designator) and any additional data. In a retrofit, the existing SAL seeker may include SAL Seeker program code 88 that performs the conventional guidance functions of extracting the designator code and generating the $\Delta X$, $\Delta Y$ guidance signals. Data extraction program code 90 can be loaded into signal processor memory to upgrade the SAL seeker in order to provide the communication interface that extracts the data from the PRF coded beam and provides the data to the fight computer. In a new design, the extraction and guidance program code may be merged together.

Figures 5A, 5B, 5C:
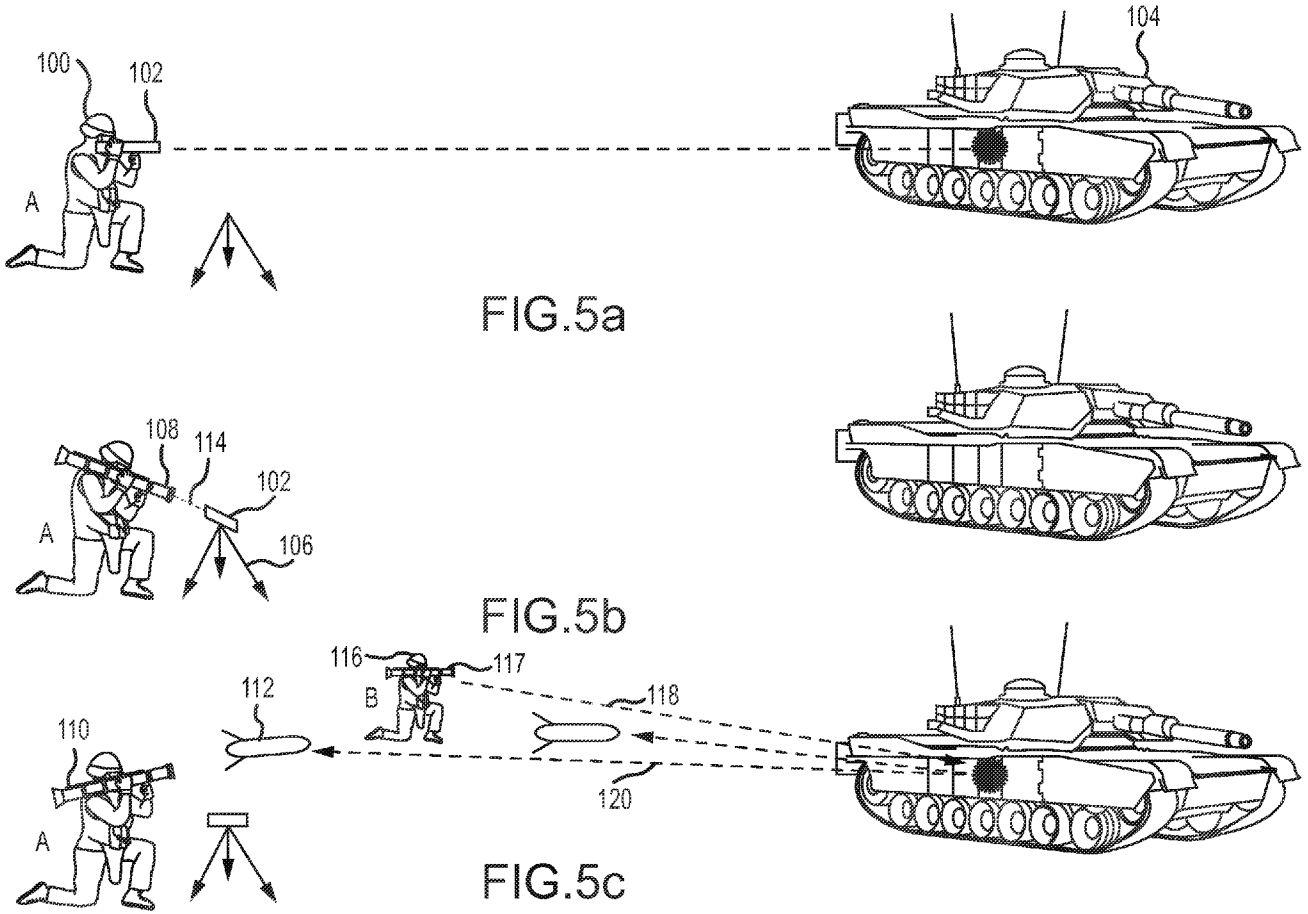
FIGS. 5*a* through 5*c* are diagrams of an embodiment in which a soldier uses a communication device to acquire and optically couple pre-launch data into a laser-guided projectile via the SAL seeker.

Referring now to FIGS. 5*a* through 5*c*, a soldier A 100 uses a communication device 102 outfitted with a laser range finder, GPS and wind sensors to acquire the range to a target 104, target location and wind speed and direction. The soldier uses the data communication interface to specify the guidance mode, fuze timing mode and fuze detonation mode. Once all the pre-launch data is acquired or input the soldier returns the communication device 102 to its tripod 106. The soldier aims a munition 108 including a launch tube 110 and laser-guided projectile 112 at the communication device 102 and initiates data transfer. Communication device 102 emits a PRF coded IR EMR beam 114 encoded with the pre-launch data that is coupled into the projectile's SAL seeker. A soldier B 116 uses a laser designator 117 to paint target 104 with a PRF coded IR laser beam 118. Soldier A aims the munition at the target to acquire the scatter EMR 120. The flight computer verifies the designator code and enables the munition. Soldier A fires the weapon. Soldier B holds the designator beam 118 on target until impact. The SAL seeker locks onto and tracks the position of the spot. The flight computer processes the guidance signals provided by the seeker to control the aerodynamic surfaces to fly the projectile to impact the painted target.

Figure 6A:
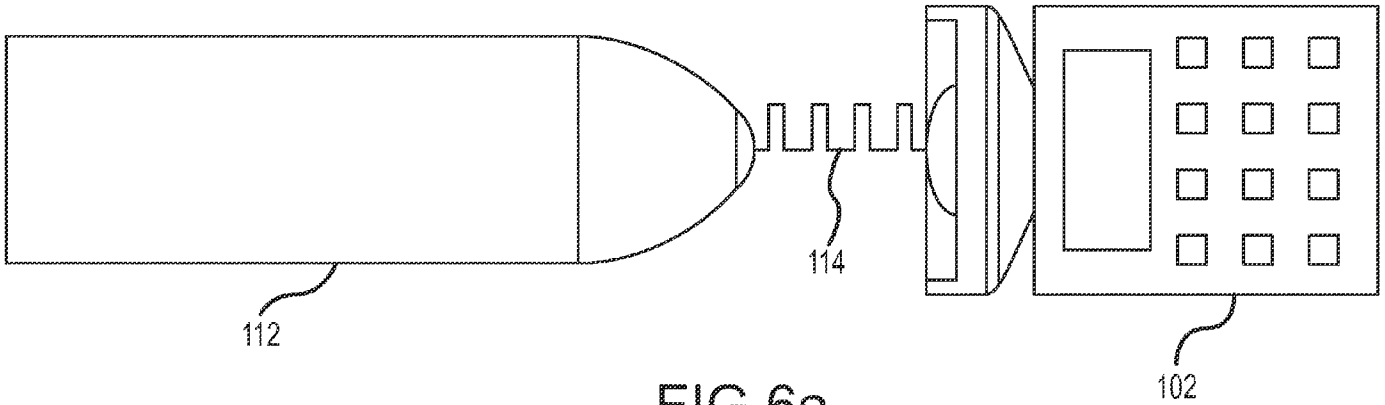
FIGS. 6*a* and 6*b* illustrate free-space and launch-tube coupled embodiments of a communication device.
Figure 6B:
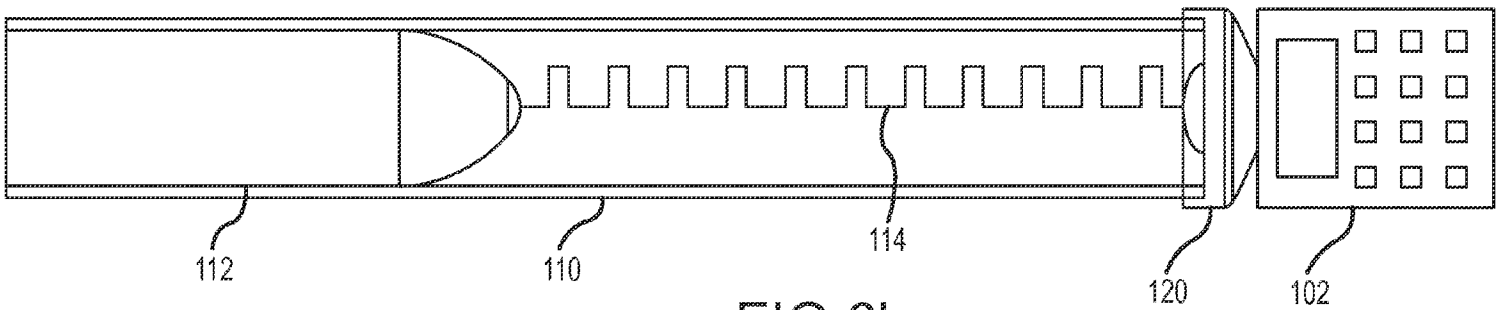

The communication device 102 may be aligned with and its beam 114 coupled to projectile 112 in a variety of ways. In FIGS. 5*a*-5*c*, the device was placed on a tripod and the soldier aligned the projectile to the device to facilitate data transfer. Referring now to FIG. 6*a*, communication device 102 may be aligned with projectile 112 prior to placing the projectile in the tube to couple beam 114 into the SAL seeker. Alternately, communication device 102 may comprise a coupling mechanism 120 that mechanically couples the communication device to the end of the tube 110 to direct the pulsed optical beam 114 through the receiver optics onto the detector assembly. This type of coupling mechanism provides both simplicity, speed and reliability that are important to soldiers tasked with firing the munitions.

Figure 7A:
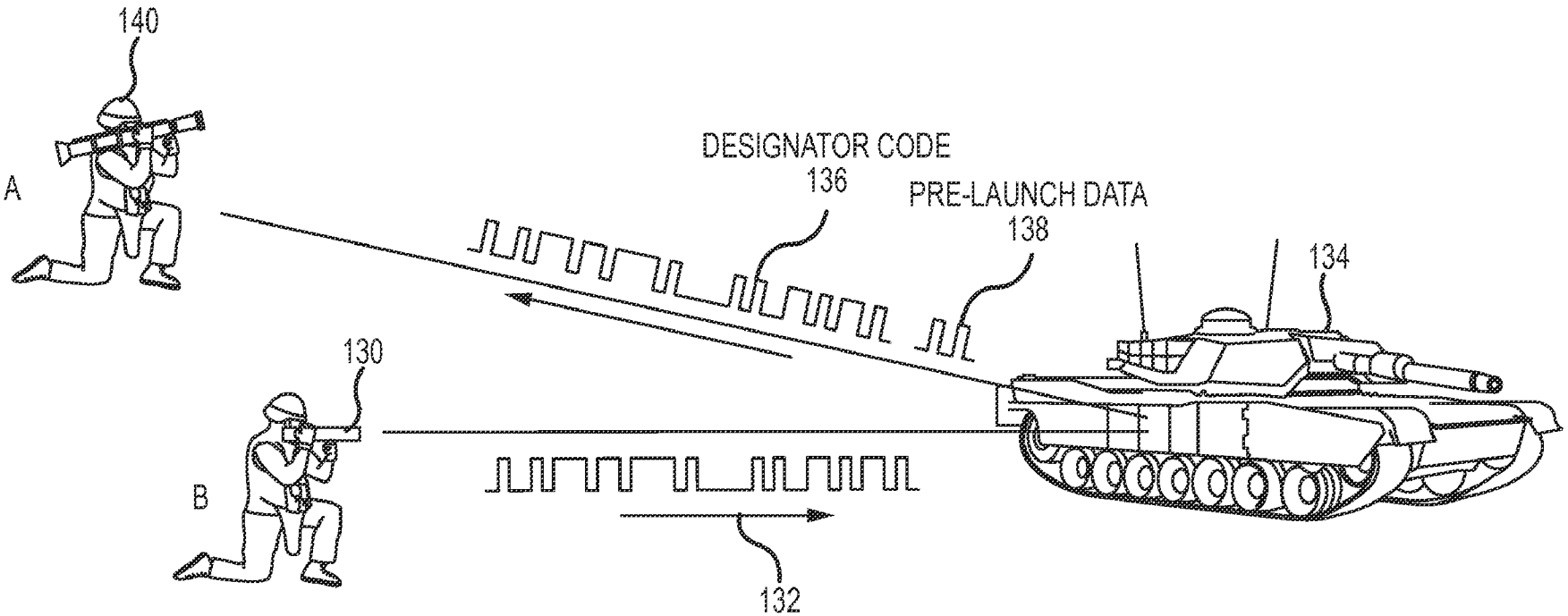
FIGS. 7*a* and 7*b* are diagrams of an embodiment in which a soldier uses a SAL designator to reflect a beam encoded with pre-launch data off a target to a laser-guided projectile's SAL seeker and to both paint the target and provide post-launch data to the SAL seeker.
Figure 7B:
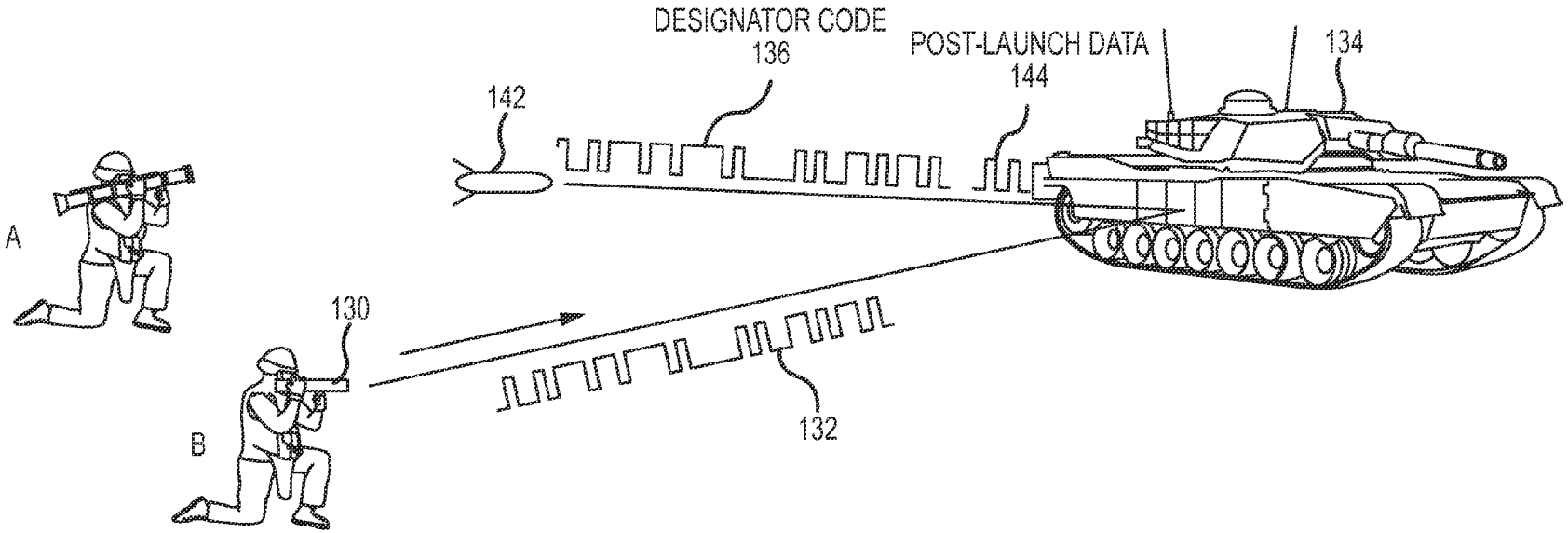

Referring now to FIGS. 7*a* and 7*b*, a SAL designator 130 may be configured to provide pre-launch data and even post-launch data in a PRF coded IR laser designator beam 132 in addition to illuminating the target 134. SAL designator 130 is modified to allow for input, selection or acquisition of the pre-launch data. Soldier B paints the target with the SAL designator beam, which is encoded with the designator code 136 and the pre-launch data 138. Soldier A aims munition 140 at the target to receive the scatter EMR. The SAL seeker demodulates the detected EMR to extract the designator code, pre-launch data and guidance signal. The flight computer verifies the designator code, updates the pre-launch and fires the laser-guided projectile.

Soldier B maintains paint on the target until projectile 142 strikes the target. Conventionally, the PRF coded beam 132 simply repeats the designator code 136. Alternately, post-launch data 144 may be encoded into the PRF coded beam 132 between instances of the designator code 136. Post-launch data may update target location, range to target, and detonation or fuze modes.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A weapons system including a laser-guided projectile, said guided projectile comprising a semi-active laser (SAL) seeker including receiver optics that capture and direct pulsed-laser electro magnetic radiation (EMR) scattered from a target to form a laser spot on a detector assembly, said assembly comprising one or more detectors each producing a signal in response to the laser power incident thereon, a signal processor and a first portion of computer-readable program code loaded into signal processor memory and executed by the signal processor to process the one or more signals to output a designator code and one or more guidance signals indicative of the position of the laser spot on the one or more detectors and the bearing to target, wherein the improvement to the weapons system comprises:

a communication device that generates a pulsed optical beam that overlaps the detection band of the one or more detectors, said pulsed optical beam encoded with data for the SAL seeker; and a second portion of computer-readable program code loaded into signal processor memory and executed by the signal processor to process the signals to extract the data for the SAL seeker.

2. The weapons system of claim 1, wherein said pulse-laser EMR is Pulse Repetition Frequency (PRF) coded, said designator code corresponding to a particular PRF code, said communication device encoding the data on the pulsed optical beam using PRF coding, said second portion of computer-readable program code extracting the data from the PRF coded pulsed optical beam.

3. The weapons system of claim 1, wherein said one or more detectors detect EMR in an infrared (IR) detection band, said communication device comprises a pulsed IR laser.

4. The weapons system of claim 1, wherein said data comprises pre-launch data, said communication device configured to optically couple the pulsed optical beam to the SAL seeker prior to launch of the guided projectile.

5. The weapons system of claim 4, wherein said pulsed optical beam is encoded with a device code that identifies the communication device to the SAL seeker.

6. The weapons system of claim 4, wherein said data includes a range-to-target for the SAL seeker.

7. The weapons system of claim 4, wherein said data includes a guidance mode for the SAL seeker.

8. The weapons system of claim 4, wherein said data includes atmospheric conditions for the SAL seeker.

9. The weapons system of claim 4, wherein said data includes target location for the SAL seeker.

10. The weapons system of claim 4, wherein said data includes a fuze timing mode for the guided projectile.

11. The weapons system of claim 4, wherein said data includes a fuze detonation mode for the guided projectile.

12. The weapons system of claim 4, wherein said communication device comprises:

a pulsed IR laser;

one or more sensors for acquiring data;

a data collection interface for acquiring data; and a data processor that processes the acquired data to encode the pulsed optical beam.

13. The weapons system of claim 4, wherein the guided projectile is fired out of a tube, said communication device comprising a coupling mechanism that mechanically couples the communication device to the end of the tube to direct the pulsed optical beam through the receiver optics onto the detector assembly.

14. The weapons system of claim 1, wherein the second portion of computer-readable program code is an upgrade to the first portion of computer-readable program code resident in an existing SAL seeker.

15. A weapons system for use with a laser designator that designates a target with a Pulse Repetition Frequency (PRF) coded pulsed IR laser beam, comprising:

a communication device that generates a PRF code for pre-launch data for a semi-active laser (SAL) seeker and modulates a pulsed IR laser beam with said PRF code; and a guided projectile, said projectile seeker comprising a SAL seeker including, receiver optics that capture and direct electro magnetic radiation (EMR) scattered from the target to form a laser spot a detector assembly, said assembly comprising one or more detectors each producing a signal in response to the laser power in a portion of the laser spot incident thereon, a signal processor;

a first portion of computer-readable program code executed by the signal processor to process the one or more signals produced in response to the laser designator to output a designator code and one or more guidance signals indicative of the position of the laser spot on the one or more detectors;

a second portion of computer-readable program code executed by the signal processor to process the signals produced in response to the communication device to extract the pre-launch data for the SAL seeker; and a flight computer that processes the pre-launch data and processes the guidance signals to determine a bearing to target and to issue control signals to aerodynamic control surfaces on the projectile.

16. The weapons system of claim 15, wherein the communication device generates and modulates the beam with a PRF device code that identifies the communication device to the SAL seeker, said data comprising at least a range-to-target.

17. The weapons systems of claim 15, further comprising:

a launch tube for firing the guided projectile;

said communication device comprising a coupling mechanism that mechanically couples the communication device to the end of the tube to direct the pulsed IR beam through the receiver optics onto the detector assembly.

18. The weapons systems of claim 15, wherein the second portion of computer-readable program code is an upgrade to the first portion of computer-readable program code resident in an existing SAL seeker.

19. A method of communicating pre-launch data to a laser-guided projectile, said projectile comprising a semi-active laser (SAL) seeker including receiver optics that capture and direct pulsed IR laser electro magnetic radiation (EMR) scattered from a target to form a laser spot on a detector assembly, said assembly comprising one or more detectors each producing a signal in response to the laser power incident thereon, a signal processor and a first portion of computer-readable program code executed by the signal processor to process the one or more signals to output a designator code and one or more guidance signals indicative of the position of the laser spot on the one or more detectors and a flight computer the verifies the designator code and processes the one or more guidance signals to determine a bearing to target and to control aerodynamic control surfaces on the projectile, said method comprising:

directing from a communication device a pulsed IR laser beam onto the SAL seeker's receiver optics and detector assembly, said beam encoded with pre-launch data for the SAL seeker; and providing a second portion of computer-readable program code executed by the signal processor to process the signals produced in response to the communication device to extract the pre-launch data for the SAL seeker.

20. The method of claim 19, wherein said pulsed IR laser EMF is Frequency (PRF) coded, said designator code corresponding to a particular PRF code, said communication device encoding the data on the pulsed optical beam using PRF coding, said second portion of computer-readable program code extracting the data from the PRF coded pulsed optical beam.

21. The method of claim 19, wherein during pre-launch the beam is encoded with a device code that identifies the communication device to the SAL seeker and pre-launch data comprising a range-to-target.

22. The method of claim 19, wherein the guided projectile is launched from a tube, further comprising:

mechanically coupling the communication device to the end of the tube to direct the pulsed IR beam through the receiver optics onto the detector assembly.

23. The method of claim 19, wherein providing the second portion of computer-readable program code comprises upgrading the first portion of computer-readable program code resident in an existing SAL seeker.

24. A weapons system including a laser-guided projectile, said guided projectile comprising a semi-active laser (SAL) seeker that detects electro magnetic radiation (EMR) scattered from a target to extract a designator code and a bearing to target, wherein the improvement to the weapons system comprises:

a communication device that generates a pulsed optical beam that overlaps the detection band of the SAL seeker, said pulsed optical beam encoded with data for the SAL seeker; and computer-readable program code loaded into and executed by the SAL seeker to extract the data from the EMR responsive to the pulsed optical beam.

* * * * *